United States Patent [19]

Viellefont et al.

[11] 4,392,934

[45] Jul. 12, 1983

[54] PROCESS AND APPARATUS FOR REPLACING CATHODES

[75] Inventors: Jean F. Viellefont, Herenthout; Robert P. L. Dierckxsens, Olen, both of Belgium

[73] Assignee: Metallurgie Hoboken-Overpelt, Brussels, Belgium

[21] Appl. No.: 282,031

[22] Filed: Jul. 10, 1981

[30] Foreign Application Priority Data

Jul. 21, 1980 [LU] Luxembourg ..... 82645

[51] Int. Cl.[3] ..... C25D 17/08; C25C 7/08; C25D 17/04; C25D 17/06

[52] U.S. Cl. ..... 204/198; 204/225; 204/269; 204/297 W

[58] Field of Search ..... 204/198, 225, 267–269, 204/297 W

[56] References Cited

U.S. PATENT DOCUMENTS

| | | | |
|---|---|---|---|
| 3,314,877 | 4/1967 | Novitsky | 204/297 W |
| 3,562,131 | 2/1971 | Jasberg | 204/198 |
| 3,792,891 | 2/1974 | Kasper et al. | 294/67 R |
| 4,028,211 | 6/1977 | Hirakawa et al. | 204/267 |

FOREIGN PATENT DOCUMENTS

| | | | |
|---|---|---|---|
| 51-42002 | 4/1976 | Japan | 204/225 |

*Primary Examiner*—Donald R. Valentine
*Attorney, Agent, or Firm*—Pennie & Edmonds

[57] ABSTRACT

A process and apparatus for removing from an electrolytic cell cathodes having an electrolytic deposit thereon and replacing them with cathodes from which said electrolytic deposit has been removed, comprising: (a) simultaneously lifting a first subgroup comprising the even-numbered cathodes from a first cell and a second subgroup comprising the odd-numbered cathodes from a second, adjacent cell while maintaining the orientation and disposition of said cathodes; (b) conveying said subgroups to a stripping installation while moving said subgroups perpendicular to the longitudinal axes of said cells until a collinear unstripped set of cathodes is formed; (c) placing said collinear unstripped set of cathodes at the entry to said stripping installation; (d) lifting a collinear stripped set of cathodes from the exit of said stripping installation, said collinear stripped set having sequentially numbered stripped cathodes equal in number, orientation and disposition to said collinear unstripped set; (e) conveying said collinear stripped set of cathodes to two adjacent cells while separating said collinear stripped set into a third subgroup comprising the even-numbered cathodes and a fourth subgroup comprising the odd-numbered cathodes of said collinear stripped set, said separating achieved by moving said third and fourth subgroup perpendicular to the longitudinal axes of said cells; and (f) simultaneously placing the cathodes of said third and fourth subgroups in two adjacent cells in the positions from which a first and a second subgroup have been removed.

8 Claims, 9 Drawing Figures

FIG. 2
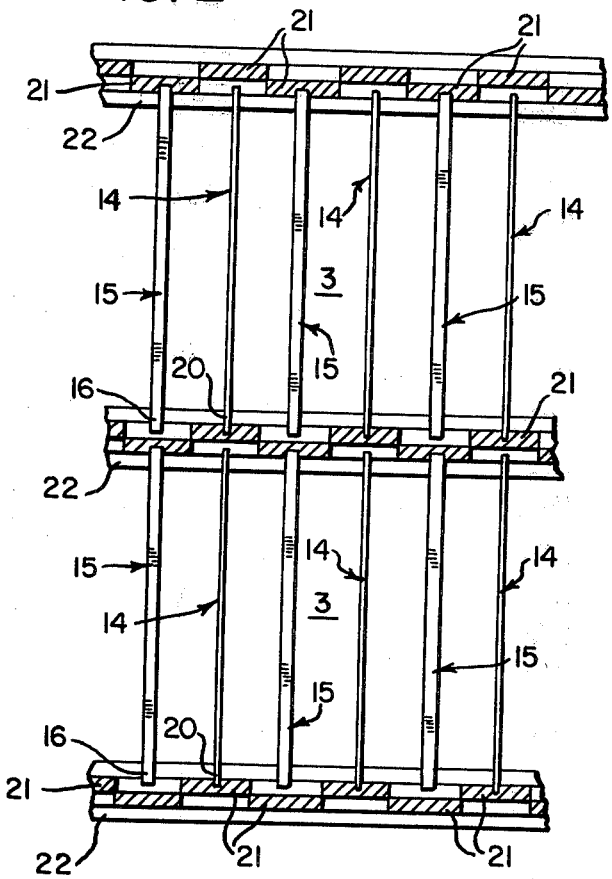
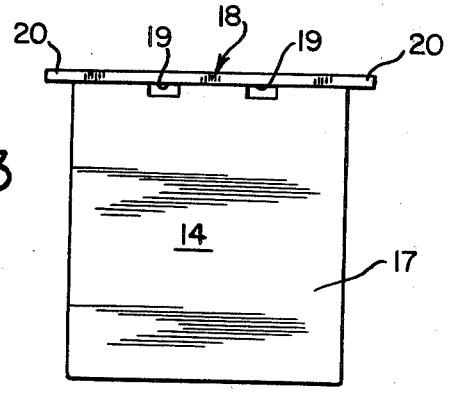
FIG. 3

PROCESS AND APPARATUS FOR REPLACING CATHODES

BACKGROUND OF THE INVENTION

The present invention relates to a process and apparatus for replacing cathodes in the cells of an electrolytic plant. In the electrolytic plant suitable for practice of the present invention, rectangular cells are positioned side by side in a plurality of rows perpendicular to the longitudinal axes of the cells. Each cell contains a group of cathodes suspended vertically at equal distance from one another and perpendicular to the longitudinal axes of the cells. According to the general concept of the invention, when the electrolytic deposit which forms on the cathodes as a result of electrolysis has reached a required thickness, (a) a subgroup of cathodes is lifted from a cell, while ensuring that the orientation and the disposition of the cathodes in the lifted subgroup remains identical to that originally in the cell, (b) the lifted subgroup is conveyed to a stripping installation in which the electrolytic deposit is stripped off the cathodes, said stripping installation having an entry for cathodes to be stripped and an exit for stripped cathodes, (c) the lifted subgroup is set down at the entry of the stripping installation, (d) a series of stripped cathodes, corresponding in number, orientation and disposition to the lifted subgroup, is lifted from the exit of the stripping installation, (e) this lifted series is conveyed to a position above said cell, and (f) the lifted series of stripped cathodes is set down in the position from which said subgroup was lifted.

In any such process for replacing cathodes only a subgroup of cathodes in a cell can be removed at one time, e.g., half of the cell charge, since the cell has to remain under current during the replacement of cathodes.

A similar process has long been used for the production of starting sheets for the electrorefining of copper. This known process is carried out as follows. When starting the replacement of the cathodes, a compact subgroup of successive (adjacent) cathodes, e.g., the front half of the cell charge, is lifted from the first cell of a row of cells. This lifted subgroup is conveyed to the stripping installation and is set down at the entry of the installation which then begins to strip the cathodes. A return is immediately made to the second cell of the same row where, once more, the front half of the cell charge is lifted and, once more, this subgroup is set down at the entry of the stripping installation. This procedure is repeated with the remaining cells of the row until the stripping installation starts to deliver stripped cathodes. At this time when half of a cell charge, e.g., from the sixth cell, is set down at the entry of the stripping installation, movement is immediately made to the exit of the stripping installation where half of a cell charge of stripped cathodes is lifted; this lifted subgroup is conveyed to the first cell where it is placed in such a way that it replaces the absent front half of the cell charge. The next forward movement is from the seventh cell to the entry of the stripping installation and the backward move immediately thereafter is from the exit of the stripping installation to the second cell. The whole row is dealt with in this way, whereafter the cathodes of the back half of the cells of the same row are replaced.

Two disadvantages of this known process are (1) the unfavorable current redistribution in the cells when the cathodes are being replaced and (2) the requirement of at least four to-and-fro movements between the cells and the stripping installation to replace two full cell charges. The latter disadvantage presents problems particularly when working with a fast operating automatic stripping installation.

In order to avoid the latter drawback it has already been proposed to simultaneously replace several compact subgroups of cathodes, e.g., two subgroups positioned side by side in adjacent cells. In these suggestions, however, use is made of either a sophisticated conveying system, as described in the U.S. Pat. No. 3,562,131, providing for each row of cells, an overhead crane, two carriages each equipped with a rack and a conveyer-belt to the stripping installation, or a sophisticated moving stripping installation, as described in the German patent application No. 2,424,383.

The aim of the present invention is to provide a process that avoids the above-mentioned disadvantages.

SUMMARY OF THE INVENTION

Therefore, the present invention relates to a process for replacing the cathodes of rectangular cells in an electrolytic plant in which said cells are positioned side by side in rows perpendicular to the longitudinal axes of the cells, each cell having a plurality of sequentially numbered cathodes suspended vertically at equal distance from one another and perpendicular to the longitudinal axes of the cells, wherein cathodes having an electrolytic deposit thereon are removed from said cells and replaced with cathodes from which said electrolytic deposit has been removed, comprising the steps of:

(a) lifting a first subgroup comprising the even-numbered cathodes from a first cell and simultaneously lifting a second subgroup comprising the odd-numbered cathodes from a second, adjacent cell while maintaining the orientation and disposition of said even-numbered and odd-numbered cathodes, thereby obtaining two subgroups of cathodes offset from one another along the longitudinal axes of said first and second cells over a distance equal to the distance between two adjacent cathodes;

(b) conveying said subgroups to a stripping installation while moving said subgroups perpendicular to the longitudinal axes of said cells until a collinear unstripped set of cathodes is formed from said even-numbered and odd-numbered subgroups, said stripping installation having an entry for cathodes having an electrolytic deposit thereon to be stripped and an exit for stripped cathodes;

(c) placing said collinear unstripped set of cathodes at the entry to said stripping installation;

(d) lifting a collinear stripped set of cathodes from the exit of said stripping installation, said collinear stripped set having sequentially numbered stripped cathodes equal in number, orientation and disposition to said collinear unstripped set;

(e) conveying said collinear stripped set of cathodes to two adjacent cells while separating said collinear stripped set into a third subgroup comprising the even-numbered cathodes and a fourth subgroup comprising the odd-numbered cathodes of said collinear stripped set, said separating achieved by moving said third and fourth subgroup perpendicular to the longitudinal axes of said cells until said third and fourth subgroups are in the same relative position as the first and second subgroups of said first and second cells, respectively; and (f) simultaneously placing the cathodes of said third and fourth subgroups in two adjacent cells, from which the respective even-numbered and odd-numbered cathodes have been removed, in the positions from which a first and a second subgroup have been removed.

The above described steps (a) through (f) can be repeated until the cathodes of an entire row of cells have been replaced.

The present invention also relates to an apparatus for the replacement of the cathodes in the cells of an electrolytic plant. In the electrolytic plant suitable for practice of the invention, there are a plurality of rectangular electrolytic cells positioned side by side to form rows perpendicular to the longitudinal axes of the cells. Each cell contains a group of cathodes suspended vertically at equal distance from one another and perpendicular to the longitudinal axes of the cells, said cathodes adapted to be lifted by means of a pair of hooks. Accordingly, the present invention relates generally to an apparatus for replacing the cathodes of rectangular cells in an electrolytic plant in which said cells are positioned side by side in rows perpendicular to the longitudinal axes of the cells, each cell having a plurality of sequentially numbered cathodes suspended vertically at equal distance from one another and perpendicular to the longitudinal axes of the cells, wherein cathodes having an electrolytic deposit thereon are removed from said cells and replaced with cathodes from which an electrolytic deposit has been removed, comprising:

(a) an overhead crane spanning said rows and adapted to move parallel to said rows of cells;

(b) a carriage movably attached to said overhead crane and adapted to move perpendicular to said rows of cells;

(c) a double rack for cathodes suspended from said carriage parallel to the longitudinal axes of said cells and adapted to move vertically, comprising:

(i) two parallel elongated rack parts each having a longitudinal axis and a row of pairs of hooks, said pairs of hooks positioned one behind another at twice the distance between adjacent cathodes of a cell; and (ii) means to change the relative positions of said rack parts between a first position in which a single collinear set of pairs of hooks is formed, said pairs of hooks positioned one behind another at the distance between adjacent cathodes, and a second position in which two separate rows of pairs of hooks are formed, the hooks of the rows of said second position being coplanar.

A similar apparatus is described in the above-mentioned German patent application No. 2,424,383. In this known apparatus movement from the first position to the second position (and vice-versa) is accomplished by moving one of the two parts of the rack obliquely with regard to its longitudinal axis. The double rack of this apparatus is built asymmetrically which leads to unbalanced operation, thus causing, of course, problems as to its suspension. Moreover, it does not allow the simultaneous replacement of cathodes in two adjacent cells when the distance between two cathodes in a cell is small, as is the case in the production of starting sheets for the electrorefining of copper. This known apparatus can be used to lift a subgroup of compact cathodes from a cell and to separate it during transport to the the stripping installation into two separate and less compact subgroups.

The aim of the present invention is to provide an apparatus of the above-defined type, avoiding the disadvantges mentioned above.

Therefore, according to the present invention, the means to change between the above-described first and second positions of the two rack parts is adapted to move the two rack parts perpendicular to their longitudinal axes. Additionally, the double rack of the apparatus includes means to move the two rack parts in either direction along their longitudinal axes for purposes of hooking and unhooking the cathodes of the cells.

Preferably, the double rack also includes means to move the two rack parts simultaneously in the same direction along their longitudinal axes.

DETAILED DESCRIPTION

The description hereafter of a mode to carry out the process and of an embodiment of the apparatus according to the invention is given only as a non-restrictive example to illustrate the invention and its advantages. This description, which relates to the replacement of cathodes in a tankhouse for the production of starting sheets for the electrorefining of copper, refers to the attached drawings in which:

FIG. 2 is a more detailed plan view of a portion of two adjacent cells of the tankhouse of FIG. 1;

FIG. 3 is a front view of a cathode;

Figure 1:
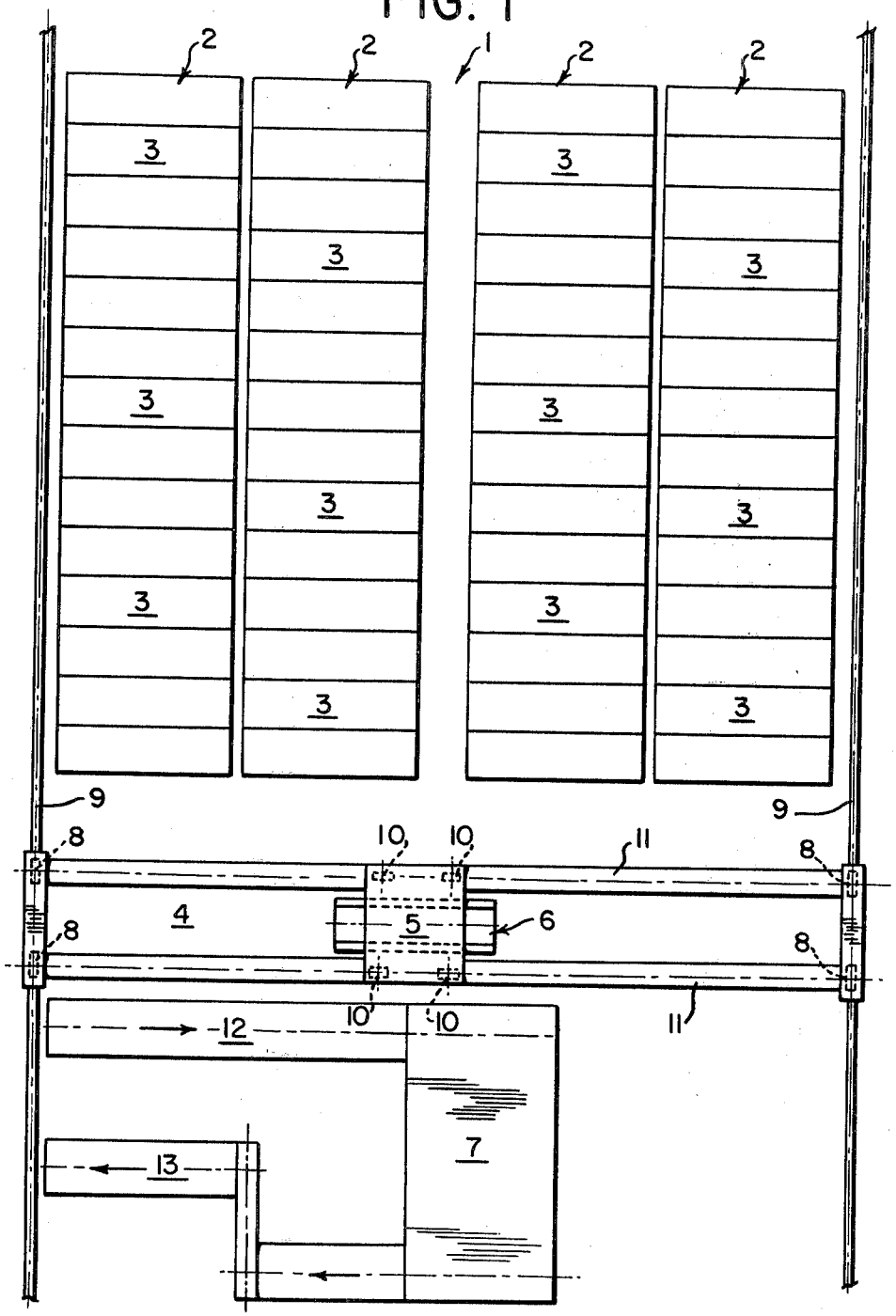
FIG. 1 represents a schematic plan view of the tankhouse.

As shown in FIG. 1, the tankhouse 1 comprises four parallel rows 2 of rectangular electrolytic cells 3 located side by side, an overhead crane 4 with carriage 5 from which is suspended a double cathode rack 6, and a stripping installation 7. The overhead crane 4, equipped with wheels 8 and driven by a motor (not shown), is adapted to move to-and-fro on rails 9 parallel to the rows of cells 2. Carriage 5, equipped with wheels 10 and driven by a motor (not shown), is adapted to move to-and-fro on rails 11, which are attached to crane 4, perpendicular to the rows of cells 2. The stripping installation 7 is provided with an entry 12 for cathodes to be stripped and with an exit 13 for stripped cathodes. The overhead crane 4 and the carriage 5 are of the conventional type and will not be further detaled. Nor will further details be given as to the construction of the stripping installation 7, as the construction thereof does not form a part of the present invention.

As shown on FIG. 2, each cell 3 comprises a group of cathodes 14 and alternating with this a group of anodes 15 suspended vertically at equal distance from one another and perpendicular to the longitudinal axis of the cell. The distance between two successive cathodes is 124 mm; each cell 3 contains thirty-two cathodes 14 and thirty-three anodes 15. An anode 15 is composed of a cast plate of impure copper with two lugs 16 protruding laterally, on its upper part, providing for suspension of anode 15 in cell 3. A cathode 14 (see FIG. 3) is composed of a plate 17 of rolled copper attached on a copper suspension-bar 18 with two openings 19 at its upper part to allow the cathode 14 to be lifted by means of a pair of hooks. The ends 20 of the suspension-bar 18 enable suspension of cathode 14 in cell 3.

Each row of cells 2 is connected at its top and bottom ends with a source of current (not shown). The current passes through a row of cells 2 in the usual way by means of copper conductors 21 located on the longitudinal walls 22 of the cells 3, each one electrically connecting a group of cathodes 14 with an adjacent group of anodes 15, as schematically represented in FIG. 2. A suitable electrolyte flows through the cells 3. The impure anodes dissolve during electrolysis and a pure copper deposit (not shown) is formed on both sides of the cathodes. When this deposit has reached a sufficient thickness, the cathodes 14 have to be replaced by stripped cathodes. For this replacement use is made of the hereafter detailed double rack 6, in combination with the overhead crane 4 and carriage 5.

Figure 4:
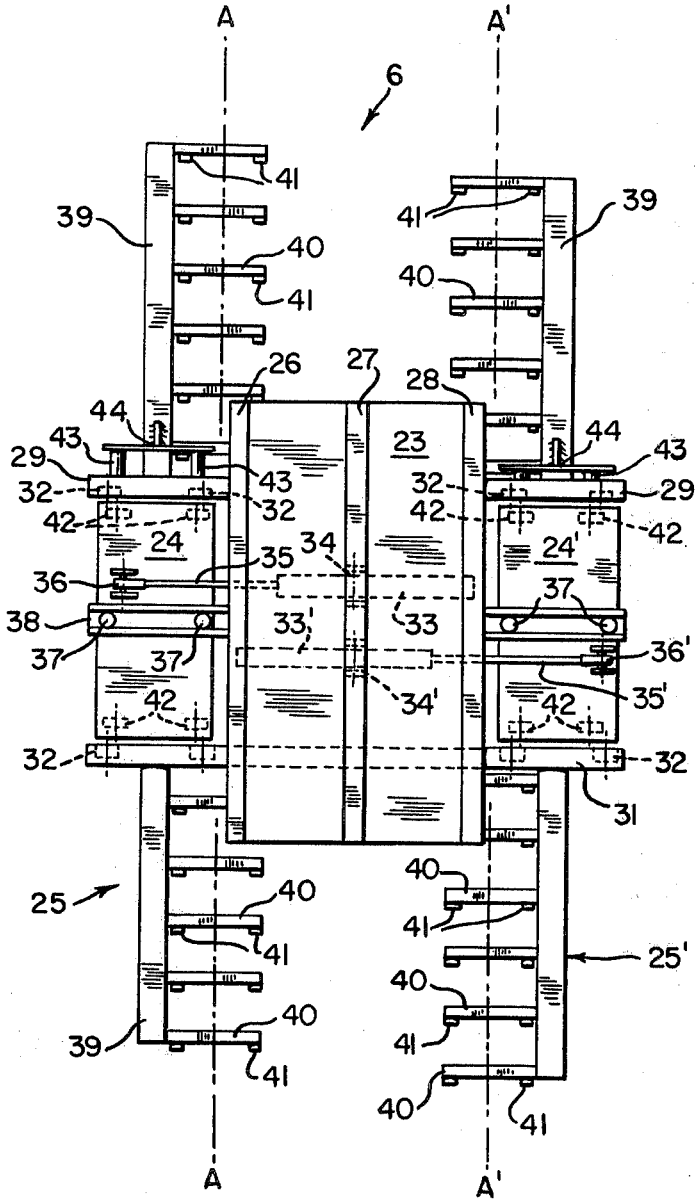
FIG. 4 is a plan view of the double rack for cathodes of the tankhouse of FIG. 1.
Figure 5:
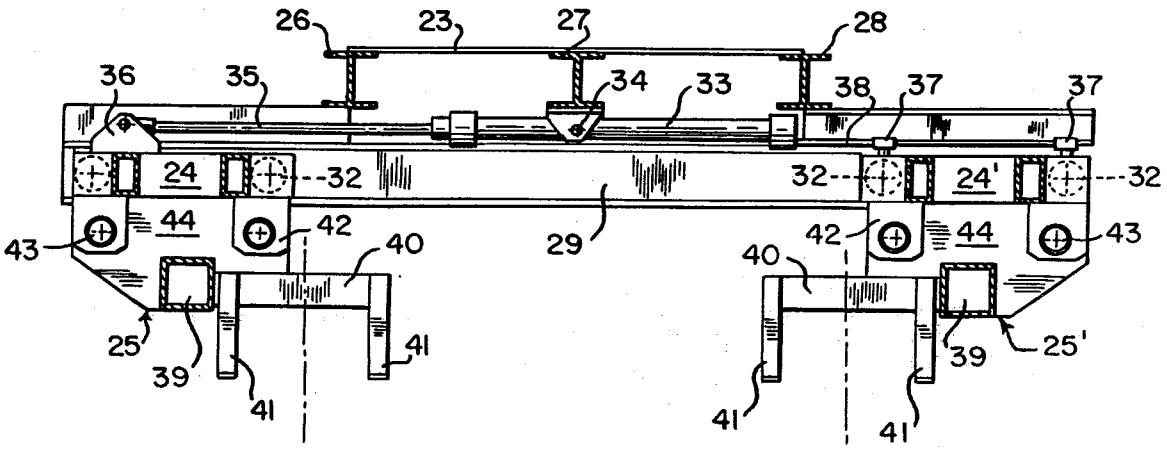
FIG. 5 is a front view of the double rack for cathodes of FIG. 4.

As shown on FIGS. 4 and 5, the double rack 6 is composed of a fixed frame 23 on which are mounted two carriages 24 and 24' each supporting a rack part 25 and 25'. The frame 23 is composed of three main beams 26, 27 and 28 and thereunder, two cross-bars 29 and 31. The cross-bars 29 and 31 have a U-shaped profile and are used as roller-tracks for the wheels 32 of the carriages 24 and 24'.

Carriage 24 is driven by a hydraulic cylinder 33 that pivots on hinge 34 fastened under the main beam 27 and the rod 35 which pivots at its end on hinge 36 that is fastened to the carriage. Carrier 24' is driven in the same way by a hydraulic cylinder 33' that pivots on hinge 34' fastened under the main beam 27 and the rod 35' which pivots at its end on hinge 36' that is fastened to the carriage. The cylinders 33 and 33' are identical and their stroke is such that, when their rods are completely in, the A—A axis of the rack part 25 coincides with the A'—A' axis of the rack part 25', and that when their rods are completely out, the distance between said axes corresponds to the distance between the axes of two adjacent cells 3. In the present case, the cylinders 33 and 33' have a 600 mm stroke. Since cylinders 33 and 33' are not located centrally with regard to the carriages 24 and 24', the latter are equipped at their upper part with a pair of guide wheels 37 for which a roller-track 38 is provided under the cross-bars 26, 27 and 28.

Each rack part 25 and 25' comprises a beam 39 to which are attached laterally a number of cross-bars 40, each provided with a pair of hooks 41. The number of cross-bars 40 per rack part corresponds to half the number of cathodes 14 in a cell 3. In the present case each rack part has sixteen cross-bars 40 or, in other words, sixteen pairs of hooks 41. The distance between two adjacent cross-bars 40 or, in other words, between two adjacent pairs of hooks, corresponds to twice the distance between two adjacent cathodes 14 in a cell 3. In the present case this distance is 248 mm. The distance between the two hooks 41 of a pair of hooks corresponds to the distance between the two openings 19 in the cathode 14, i.e., 340 mm in the present case.

Figure 6:
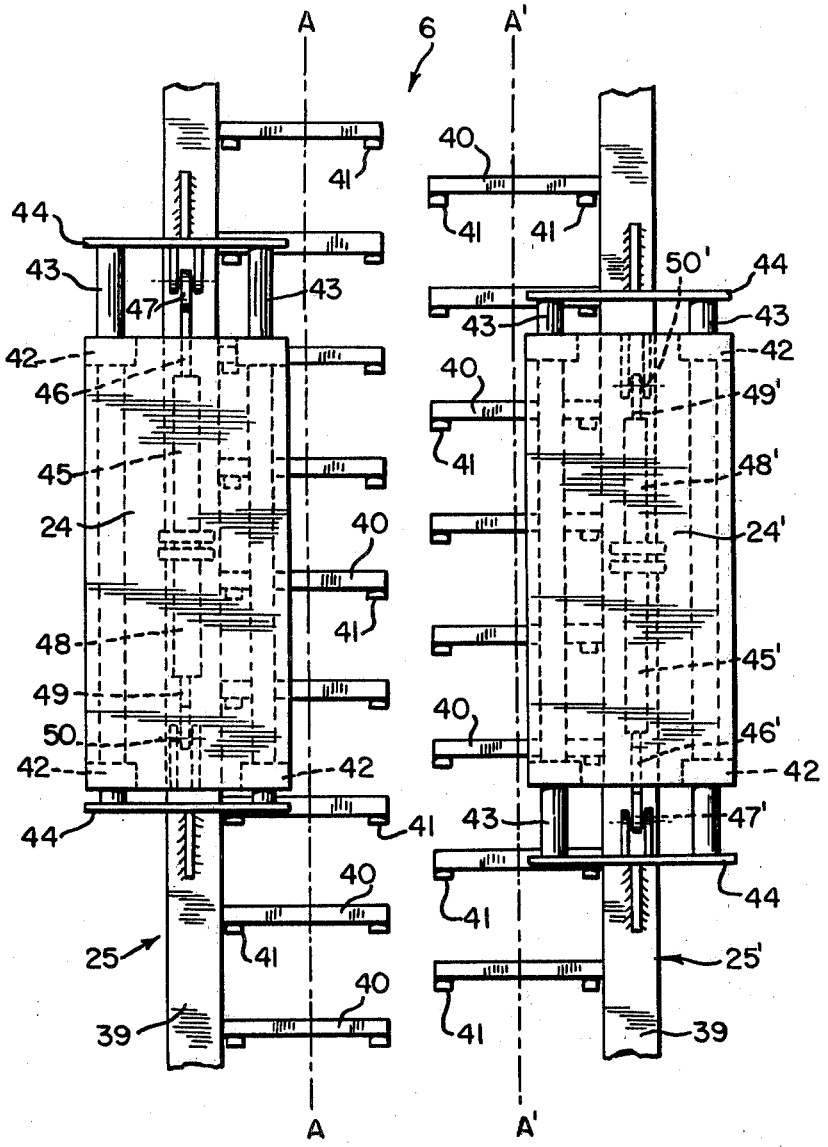
FIG. 6 is a more detailed plan view of the central part of the double rack of FIG. 4.
Figure 7:
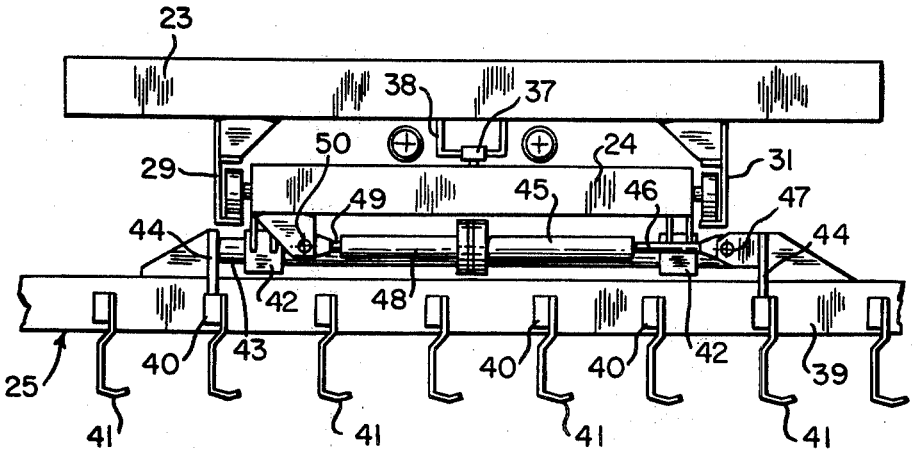
FIG. 7 is a side view of the central part shown in FIG. 6.

As shown on FIG. 6, in which, for purposes of clarity, the frame 23 and the cylinders driving carriages 24 and 24' are not shown, and in FIG. 7, each rack part 25 and 25' is mounted under its carriage 24 and 24', so that it can move along its longitudinal axis in relation to the carriage. Therefore, each carriage 24 and 24' is provided, at its lower part, with two pairs of gliding sockets 42 through which pass a pair of gliding rods 43, the ends of which are fastened to two perpendicular plates 44 which are in turn fastened to the beam 39.

Carriage 24 is also equipped, at its lower part, with two hydraulic cylinders connected together at their backs: cylinder 45, that may be defined as a cylinder for shifting from even- to odd-numbered cathodes and the rod 46 of which pivots at its end on hinge 47 that is fastened to the perpendicular plate 44 on the back side, i.e., the one that is located at the top of FIG. 6, and cylinder 48, that may be defined as a pick-on and pick-off cylinder and the rod 49 of which pivots at its end on hinge 50 that is fastened under carriage 24. When rod 46 is moved in, the rack part 25 is moved toward the bottom of FIG. 6; when rod 46 is pushed out, the rack part 25 moves toward the top of FIG. 6. When rod 49 is moved in, the rack part 25 is moved toward the bottom of FIG. 6 and vice-versa.

In the same way the under part of the carriage 24' is equipped with a cylinder 45' for shifting from even- to odd-numbered cathodes, the rod 46' of which pivots at its end on hinge 47', that is fastened on the front perpendicular plate 44, and a pick-on and pick-off cylinder 48', the rod 49' of which pivots at its end on hinge 50', that is fastened under carriage 24'. When rod 46' is moved in, the rack part 25' is moved upward (FIG. 6) and vice-versa. The inward movement of rod 49' also makes the rack part 25' move upward (FIG. 6) and vice-versa. The cylinders 45 and 45' for shifting from even- to odd-numbered cathodes have strokes that correspond to the distance between two adjacent cathodes 14, i.e., a 124 mm stroke in the present case.

When the rods 46, 46' and 49 are completely out and rod 49' is in, the double rack 6 has the configuration of FIG. 4, in which the right rack part 25' is in advance of the left rack part 25 over a distance that corresponds to the distance between two adjacent cathodes 14 in cell 3. When rod 49' is out and rod 49 is in, the two rack parts 25 and 25' move downward over a distance of 50 mm.

When the rods 46, 46' and 49' are in and rod 49 is out, the double rack 6 has an inverse configuration to the one of FIG. 4, which means that the left rack part 25 is in advance of the right rack part 25' over a distance of 124 mm. When in this position rod 49' is pushed out and rod 49 is withdrawn, the two rack parts 25 and 25' will move again downward over a distance of 50 mm.

Figure 8:
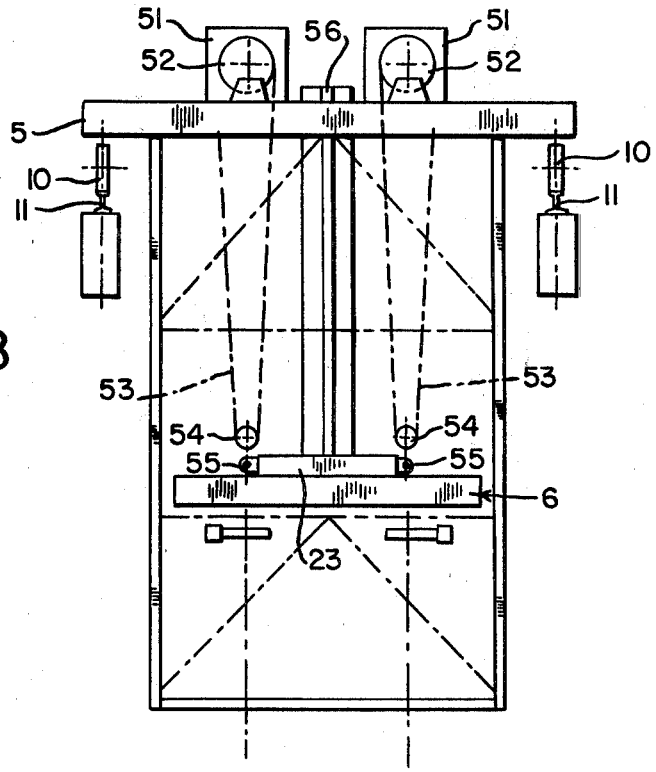
FIG. 8 is a schematic front view of the suspension system of the double rack.

As shown in FIG. 8, the double rack 6 is suspended in the usual way on a gear-box 51 with four drums 52 by means of four cables 53 and four pulleys 54, these being connected by hooks (not shown) at the four suspending eyelets 55 fastened on frame 23 of the double rack 6. The guiding device 56 prevents all but vertical movements of the frame 23 with respect to the carriage 5.

Figure 9:
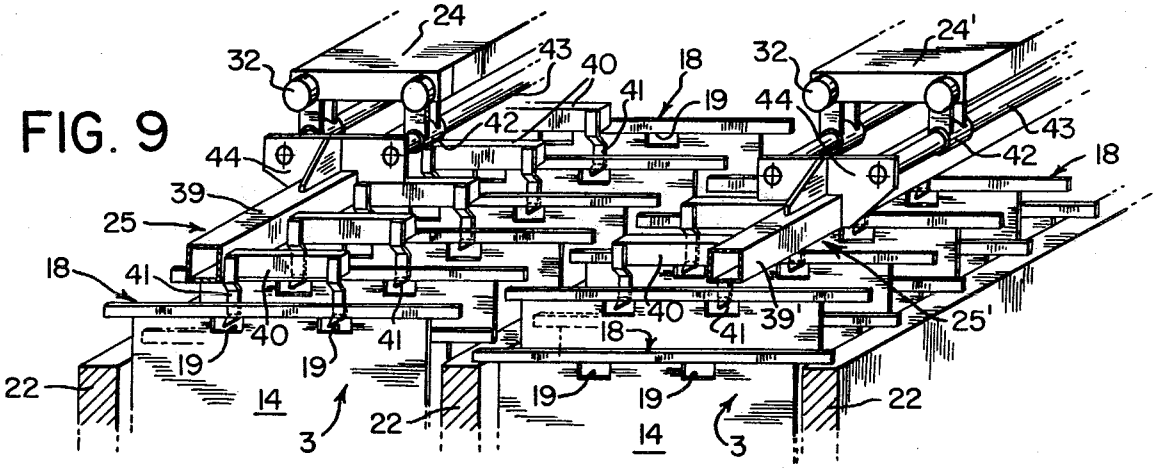
FIG. 9 is a perspective view of a double rack in operation.

With the above-described apparatus one can proceed as follows. When the replacement of cathodes is started, the double rack 6 is lifted to the gearbox 51 and has the configuration of FIG. 4, i.e., the rods 35, 35', 49, 46 and 46' are out and rod 49' is in. The crane 4 is moved to just above the head of the row of cells 2, i.e., the end at the bottom of FIG. 1, so that the A—A axis of rack part 25 corresponds to the axis of the first cell 3 and the axis A'—A' of the rack part 25' with the axis of the second cell 3. Carriage 5 is then driven above the first row of cells 2, e.g., the row of cells 2 at the left of FIG. 1, so that the first pair of hooks 41 of the rack part 25, i.e., the one at the bottom of FIG. 4, is located above the space between the second cathode 14 of the first cell 3 and the subsequent anode 15. The double rack 6 is lowered to such position that the pairs of hooks 41 are located at the level of openings 19 of cathodes 14. Rod 49' is now pushed out and rod 49 is moved in, making the two rack parts 25 and 25' move 50 mm forward (downward in FIG. 6) and making the pairs of hooks 41 of the rack part 25 arrive with their feet in the openings 29 of the even-numbered cathodes 14 of the first cell, whereas the pairs of hooks 41 of the rack part 25' arrive with their feet in the openings 29 of the odd-numbered cathodes 14 of the second cell. The double rack 6 is then lifted, thereby obtaining the configuration of FIG. 9, in which, for reasons of clarity, the anodes 25 are not represented.

The overhead crane 4 is then driven above entry 12 of the stripping installation 7. Meanwhile rods 35 and 35' are moved inward so that the A—A axis of rack part 25 coincides with the axis A'—A' of the rack part 25' and that a compact group of lifted cathodes 14 is obtained. After driving carriage 5 above entry 12, the double rack 6 is lowered to such position in which the ends 20 of the suspension-bars 18 of the cathodes 14 rest on a conveyor (not shown) provided at entry 12, thereby freeing the feet of the pairs of hooks 41 in the openings 19. Rod 49' is then again moved in and rod 49 is pushed out, which makes the two rack parts 25 and 25' move 50 mm upward (FIG. 6), i.e., backward out of openings 29, thus freeing the pairs of hooks 41 from the cathodes 14 which are now suspended at entry 12 of the stripping installation 7. The double rack 6 is lifted, the overhead crane 4 is driven above the third and fourth cells 3 of the rows of cells 2 and meanwhile, the rods 35 and 35' are pushed out again.

The above-described operation is now repeated for the third and fourth cell 3 of the first row of cells 2. This operation is repeated once more for the fifth and sixth cells of the first row of cells. Meanwhile the stripping installation 7 has started to deliver cathodes, the electrolytic deposit of which has been stripped off, at the exit 13, so that the replacement of the cathodes can begin. When the even-numbered cathodes from the seventh cell and the odd-numbered cathodes from the eighth cell are set down in the form of a compact group at the entry 12 of the stripping installation, the overhead crane 4 is immediately moved to exit 13 of the stripping installation 7, where the double rack 6 is lowered and where a compact group of stripped cathodes is lifted. While the overhead crane 4 is driven to a position above the head of the rows of cells 2 the rods 35 and 35' are pushed out, and the carriage 5 is driven above the first and second cell of the first row of cells 2 in the same position as for the first operation in these cells. The double rack 6 is then lowered until the ends 20 of the suspension-bars 18 of the stripped cathodes 14 rest on the walls 22 of the cells, thus freeing the feet of the pairs of hooks 41 in the openings 19. The two rack parts 25 and 25' are moved 50 mm backwards, by moving rod 49' in, and pushing rod 49 out, and the double rack 6 is again lifted. The even-numbered cathodes of the first cell of the first row of cells are thus replaced simultaneously with the odd-numbered cathodes of the second cell of the same row.

The next forward move is then from the ninth and tenth cells of the first row of cells to the entry 12 of the stripping installation 7, and the following backward move from the exit 13 of the stripping installation 7 to the third and fourth cells of the first row of cells. The whole first row of cells is dealt with in this way before proceeding to the next row until all even-numbered cathodes of the odd-numbered cells and all odd-numbered cathodes of the even-numbered cells have been replaced. Then the rods 46 and 46' is withdrawn and replacement begins for the odd-numbered cathodes of the odd-numbered cells and the even-numbered cathodes of the even-numbered cells.

It can be readily seen that it is possible to have many alternatives and variations in the above-described process. One could just as well start with the replacement of the odd-numbered cathodes of the odd-numbered cells and of the even-numbered cathodes of the even-numbered cells. It is also possible to completely finish replacement of the cathodes of one or two rows before proceeding with the others. Once the stripping installation is in full operation, it is also possible to replace alternately an even-odd arrangement and an odd-even arrangement. It is clear that the essence of the process of the invention involves one replacement cycle using a complete group of cathodes formed by the even-numbered cathodes of one cell and the odd-numbered cathodes of an adjacent cell. It is also clear that the process of the invention has the advantage that there is an equal current redistribution in the cells in which the replacement takes place, that the number of to-and-fro movements between the electrolytic cells and the stripping installation is reduced by half, and that application in existing electrolytic plants involves only small investment costs, since it requires only the replacement of the existing racks by the above-described double rack.

It is to be understood that the invention is not to be restricted to the above-described embodiment and that many modifications may be made without departing from the scope of the present invention. The above-described hydraulic driving means may, for example, be replaced by pneumatic or electric driving means.

We claim:

1. A process for replacing the cathodes of rectangular cells in an electrolytic plant in which said cells are positioned side by side in rows perpendicular to the longitudinal axes of the cells, each cell having a plurality of sequentially numbered cathodes suspended vertically at equal distance from one another and perpendicular to the longitudinal axes of the cells, wherein cathodes having an electrolytic deposit thereon are removed from said cells and replaced with cathodes from which said electrolytic deposit has been removed, comprising the steps of:

(a) lifting a first subgroup comprising the even-numbered cathodes from a first cell and simultaneously lifting a second subgroup comprising the odd-numbered cathodes from a second, adjacent cell while maintaining the orientation and disposition of said even-numbered and odd-numbered cathodes, thereby obtaining two subgroups of cathodes offset from one another along the longitudinal axes of said first and second cells over a distance equal to the distance between two adjacent cathodes;

(b) conveying said subgroups to a stripping installation while moving said subgroups perpendicular to the longitudinal axes of said cells until a collinear unstripped set of cathodes is formed from said even-numbered and odd-numbered subgroups, said stripping installation having an entry for cathodes having an electrolytic deposit thereon to be stripped and an exit for stripped cathodes;

(c) placing said collinear unstripped set of cathodes at the entry of said stripping installation;

(d) lifting a collinear stripped set of cathodes from the exit of said stripping installation, said collinear stripped set having sequentially numbered stripped cathodes equal in number, orientation and disposition to said collinear unstripped set;

(e) conveying said collinear stripped set of cathodes to two adjacent cells while separating said collinear stripped set into a third subgroup comprising the even-numbered cathodes and a fourth subgroup comprising the odd-numbered cathodes of said collinear stripped set, said separating achieved by moving said third and fourth subgroup perpendicular to the longitudinal axes of said cells until said third and fourth subgroups are in the same relative position as the first and second subgroups of said first and second cells, respectively; and (f) simultaneously placing the cathodes of said third and fourth subgroups in two adjacent cells, from which the respective even-numbered and odd-numbered cathodes have been removed, in the positions from which a first and a second subgroup have been removed.

2. The process of claim 1, wherein steps (a) through (f) are repeated until the cathodes of an entire row of cells have been replaced.

3. An apparatus for replacing the cathodes of rectangular cells in an electrolytic plant in which said cells are positioned side by side in rows perpendicular to the longitudinal axes of the cells, each cell having a plurality of sequentially numbered cathodes suspended vertically at equal distance from one another and perpendicular to the longitudinal axes of the cells, wherein cathodes having an electrolytic deposit thereon are removed from said cells and replaced with cathodes from which an electrolytic deposit has been removed, comprising:

(a) an overhead crane spanning said rows and adapted to move parallel to said rows of cells;

(b) a carriage movably attached to said overhead crane and adapted to move perpendicular to said rows of cells;

(c) a double rack for cathodes suspended from said carriage parallel to the longitudinal axes of said cells and adapted to move vertically, comprising:

(i) two parallel elongated rack parts each having a longitudinal axis and a row of pairs of hooks, said pairs of hooks positioned one behind another at twice the distance between adjacent cathodes of a cell; and (ii) means to change the relative positions of said rack parts between a first position in which a single collinear set of pairs of hooks is formed, said pairs of hooks positioned one behind another at the distance between adjacent cathodes, and a second position in which two separate rows of pairs of hooks are formed, the hooks of the rows of said second position being coplanar, wherein the means to change the relative positions of said rack parts is adapted to move the two rack parts perpendicular to their longitudinal axes.

4. The apparatus of claim 3, wherein the double rack further comprises means to move the two rack parts in either direction along their longitudinal axes.

5. The apparatus of claim 4, wherein said means to move the two rack parts in either direction along their longitudinal axes is adapted to move said rack parts simultaneously in the same direction.

6. A double rack for cathodes for use in an apparatus for replacing the cathodes of rectangular cells in an electrolytic plant in which said cells are positioned side by side in rows perpendicular to the longitudinal axes of the cells, each cell having a plurality of sequentially numbered cathodes suspended vertically at equal distance from one another and perpendicular to the longitudinal axes of the cells, comprising:

(a) two parallel elongated rack parts each having a longitudinal axis and a row of pairs of hooks, said pairs of hooks positioned one behind another at twice the distance between adjacent cathodes of a cell; and (b) means to change the relative positions of said rack parts between a first position in which a single collinear set of pairs of hooks is formed, said pairs of hooks positioned one behind another at the distance between adjacent cathodes, and a second position in which two separate rows of pairs of hooks are formed, the hooks of the rows of said second position being coplanar, wherein the means to change the relative positions of said rack parts is adapted to move the two rack parts perpendicular to their longitudinal axes.

7. The double rack of claim 6, further comprising means to move the two rack parts in either direction along their longitudinal axes.

8. The double rack of claim 7, wherein said means to move the two rack parts in either direction along their longitudinal axes is adapted to move said rack parts simultaneously in the same direction.

* * * * *